US007976397B2

(12) United States Patent
Voden

(10) Patent No.: US 7,976,397 B2
(45) Date of Patent: Jul. 12, 2011

(54) ROTARY GAME TABLE

(76) Inventor: Justin L. Voden, Waukesha, WI (US)

( * ) Notice: Subject to any disclaimer, the term of this patent is extended or adjusted under 35 U.S.C. 154(b) by 886 days.

(21) Appl. No.: 11/183,426

(22) Filed: Jul. 18, 2005

(65) Prior Publication Data

US 2005/0250589 A1 Nov. 10, 2005

Related U.S. Application Data

(63) Continuation of application No. 10/455,666, filed on Jun. 5, 2003, now Pat. No. 7,762,902, which is a continuation-in-part of application No. 10/337,623, filed on Jan. 7, 2003, now Pat. No. 6,764,409.

(51) Int. Cl.
*A63D 15/04* (2006.01)
*A63D 15/00* (2006.01)
*A63D 13/00* (2006.01)

(52) U.S. Cl. ..... 473/10; 473/14; 473/16

(58) Field of Classification Search ..... 473/1, 4, 473/6, 9, 10, 14–16, 19; 108/1, 11, 12, 19, 108/94; D21/318, 385, 397; 273/309, 108.1
See application file for complete search history.

(56) References Cited

U.S. PATENT DOCUMENTS

| | | | | |
|---|---|---|---|---|
| 122,830 | A | 1/1872 | Heyl | |
| 211,083 | A | 1/1879 | Bensinger | |
| 747,726 | A | 12/1903 | Karhan | |
| 2,008,613 | A * | 7/1935 | Hernes | 108/90 |
| 2,174,613 | A * | 10/1939 | Blaschke | 221/199 |
| 3,227,105 | A * | 1/1966 | Braude et. al. | 108/13 |
| 3,770,334 | A * | 11/1973 | Weber | 312/223.4 |
| 3,866,913 | A | 2/1975 | Zimmers et al. | |
| D247,127 | S | 1/1978 | Kavka | |
| 4,305,581 | A | 12/1981 | Neuharth | |
| 4,927,140 | A | 5/1990 | Pappas | |
| 6,109,607 | A | 8/2000 | Cartwright et al. | |
| 6,155,564 | A | 12/2000 | Tsai | |
| 6,347,797 | B1 | 2/2002 | Tsai | |
| 6,349,939 | B1 * | 2/2002 | Tsai | 273/108.1 |
| 6,764,409 | B1 | 7/2004 | Voden | |

FOREIGN PATENT DOCUMENTS

EP 238471 A2 * 9/1987

* cited by examiner

*Primary Examiner* — Mitra Aryanpour
(74) *Attorney, Agent, or Firm* — Michael Best & Friedrich LLP

(57) ABSTRACT

A rotary game table includes a combination game table, two side support members, and at least one cross member. The combination game table includes a pool table surface formed on one side and an air powered hockey table surface formed on the opposite side. The at least one cross member is terminated on each end by a single side support member. The combination game table is pivotally retained by a side support member on each end thereof. To pivotally constrain the combination game table, at least one locking pin device is used; in a second embodiment at least two pivotal support arms; and in a fourth embodiment a pair of support latches. A third embodiment includes at least one side support member configured to retain a plurality of game accessories. A gaming table may be substituted for the air hockey table.

19 Claims, 14 Drawing Sheets

ROTARY GAME TABLE

CROSS-REFERENCES TO RELATED APPLICATIONS

This application is a continuation of, and claims priority to, U.S. application Ser. No. 10/455,666, filed on Jun. 5, 2003 now U.S. Pat. No. 7,762,902, which is a continuation-in-part of U.S. application Ser. No. 10/337,623, filed on Jan. 7, 2003 now issued U.S. Pat. No. 6,764,409.

BACKGROUND OF THE INVENTION

1. Field of the Invention

The present invention relates generally to game tables and more specifically to a rotary game table, which provides two of the following, a full size pool table, an air powered hockey table or a gaming table by rotation of a combination game table.

2. Discussion of the Prior Art

It appears that the prior art does not disclose a combination full size pool table and air powered hockey table in one rotatable structure. U.S. Pat. No. 4,305,581 to Neuharth discloses a pivotable playing table. A billiard table is pivotally supported by two pedestals in either a horizontal or vertical orientation. U.S. Pat. No. 6,155,564 to Tsai discloses an air system structure of rotary game table. A double sided game surface is pivotally retained in a game table base. The double sided game surface includes table soccer on one surface and an air powered hockey table on the opposite surface. U.S. Pat. No. 6,347,797 discloses a game table with using modes convertible by way of rotation. A table body is pivotally retained in a table frame. The table body includes, in one embodiment, table soccer on one surface and a pool table on the opposite surface.

Accordingly, there is a clearly felt need in the art for a rotary game table, which provides two of the following, a full size pool table, an air powered hockey table or a gaming table by rotation of a combination game table and manipulation of a securing device.

SUMMARY OF THE INVENTION

The present invention provides a rotary game that is rotated to provide two of the following, a full size pool table, an air powered hockey table or a gaming table. A rotary game table includes a combination game table two side support members and at least one cross member. The combination game table includes a full size pool table surface formed on one side of the combination game table and an air powered hockey table surface formed on the opposite side. The size of the pool table surface is the same as a regulation size pool table. A plurality of pool ball pockets are formed in the pool table surface that are sized to receive normal sized pool balls. A net is preferably used to capture a billiard ball that falls into one of the pool ball pockets. However, other devices may be used to capture a billiard ball that falls into a pool ball pocket, such as a plastic molded pocket.

The air powered hockey table surface includes a plurality of air holes formed through the table surface. A diffuser plate is disposed below the air powered hockey table surface. An air blower is preferably retained in a sliding drawer between the pool table surface and the diffuser plate. An air hole is formed through the diffuser plate to receive an output of the air blower. The air blower draws air from inside the combination game table and pushes the air through the plurality of air holes. A puck slot is disposed on each end of the air powered hockey table to provide scoring in a game of air powered hockey.

Preferably, at least one accessory retainer is terminated on each end with a single side support member. The at least one cross member is also terminated on each end by a single side support member. The combination game table is pivotally retained by a single side support member on each end thereof. At least one locking pin device is disposed in each side support member. Each locking pin device is preferably spring loaded such that a spring pin is in a normally extended position. At least one pin cavity is formed in each end of the combination game table to receive the at least one locking pin. The at least one locking pin is withdrawn from the at least one pin cavity to allow the game table to be rotated. A separate locking pin may also be used that is withdrawn from each side support member.

A second embodiment of a rotary game table includes a combination game table, two side support members, at least two pivotal support arms and at least one cross member. The combination game table is the same as in the first embodiment. Preferably, at least one accessory retainer acts as the at least one cross member. The at least one accessory retainer is terminated on each end with a single side support member. The combination game table is pivotally retained by one side support member on each end thereof. Each pivotal support arm is pivotally attached to one end of one side support member. The pivotal support arms are swung such that they are parallel with the side support members when rotating the combination game table. Each pivotal support arm is attachable to a single accessory retainer with any suitable quick release fastener. The at least one locking pin device may also be disposed in each side support member.

A third embodiment of a rotary game table includes a combination game table, two side support members, and at least one cross member. The combination game table is the same as in the first embodiment. The at least one cross member is terminated on each end with a single side support member. The combination game table is pivotally retained by one side support member on each end thereof. At least one locking pin device is disposed in each side support member.

A pivotal support arm may substituted for the at least one locking pin device. Each pivotal support arm would be pivotally attached to one end of one side support member. The pivotal support arms are swung such that they are parallel with the side support members when rotating the combination game table. Each pivotal support arm is attachable to a single cross member with any suitable quick release fastener.

At least one of the two side support members is preferably configured to retain game accessories such as a plurality of billiard balls, cue sticks, a rack, a puck, and two hockey paddles. A plurality of game accessories is defined by at least two billiard balls.

A fourth embodiment of a rotary game table includes a combination game table, two side support members, and at least one cross member. The combination game table is the same as in the first embodiment. The at least one cross member is terminated on each end with a single side support member. The combination game table is pivotally retained by one side support member on each end thereof. Preferably, two support latches are in each side support member. One of the two side support members is preferably configured to retain game pool accessories such as a plurality of billiard balls, a rack and a brush, and the other one of the two side support member is preferably configured to retain hockey accessories such as two paddles and a puck.

A gaming table surface may be substituted for the air hockey table surface. The gaming table surface includes a gaming pocket formed in the combination game table and at least one gaming insert. The gaming insert is preferably retained with a plurality of lock clips. A dealer chip holder and player chip holders are also formed adjacent the gaming table surface.

Accordingly, it is an object of the present invention to provide a rotary game table, which provides two of the following, a pool (billiards) table, an air powered hockey table or a gaming table in a combination game table.

These and additional objects, advantages, features and benefits of the present invention will become apparent from the following specification.

DETAILED DESCRIPTION OF THE PREFERRED EMBODIMENTS

Figure 1:
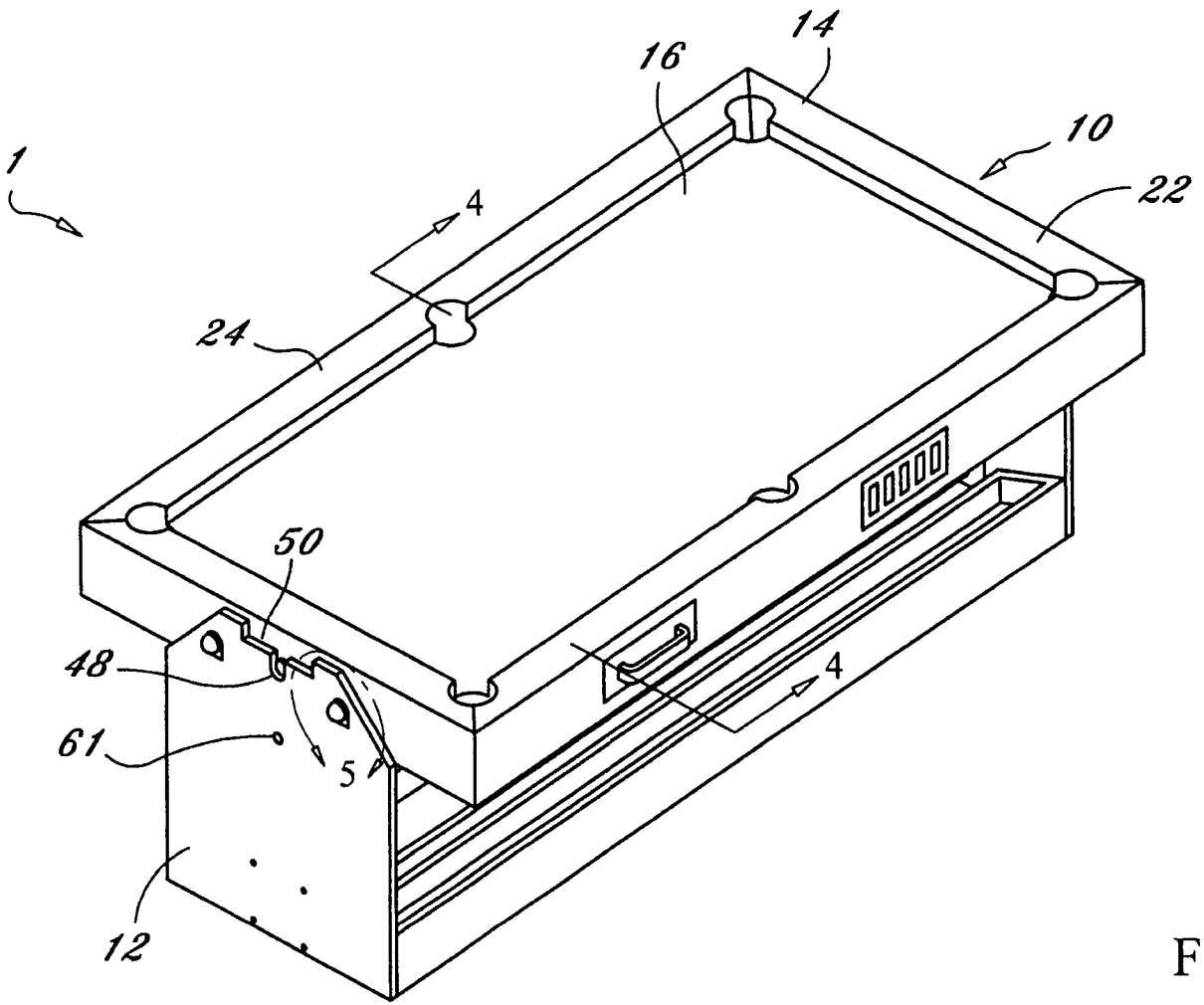
FIG. 1 is a perspective view of a rotary game table in accordance with the present invention.
Figure 2:
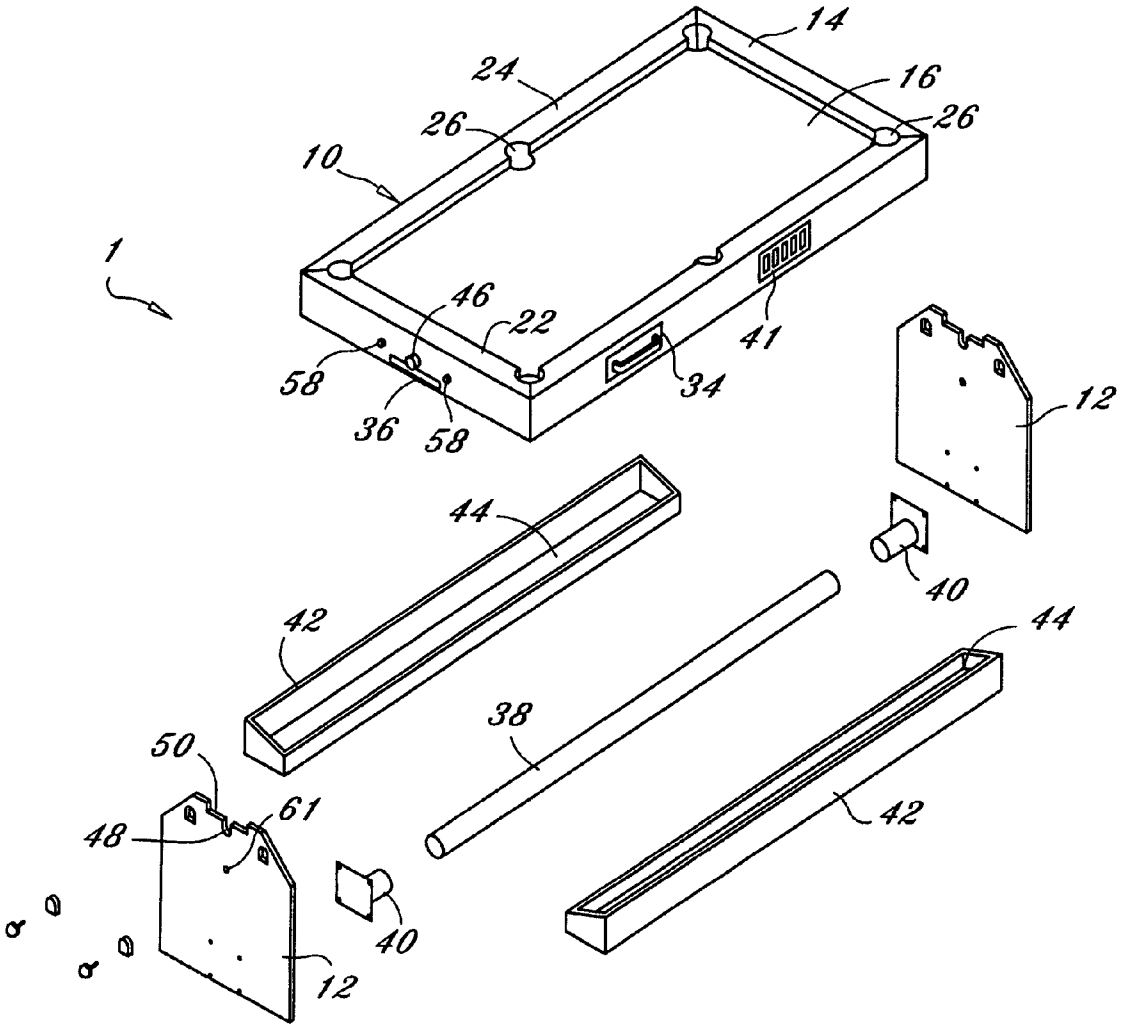
FIG. 2 is a partially exploded perspective view of a rotary game table in accordance with the present invention.
Figure 3:
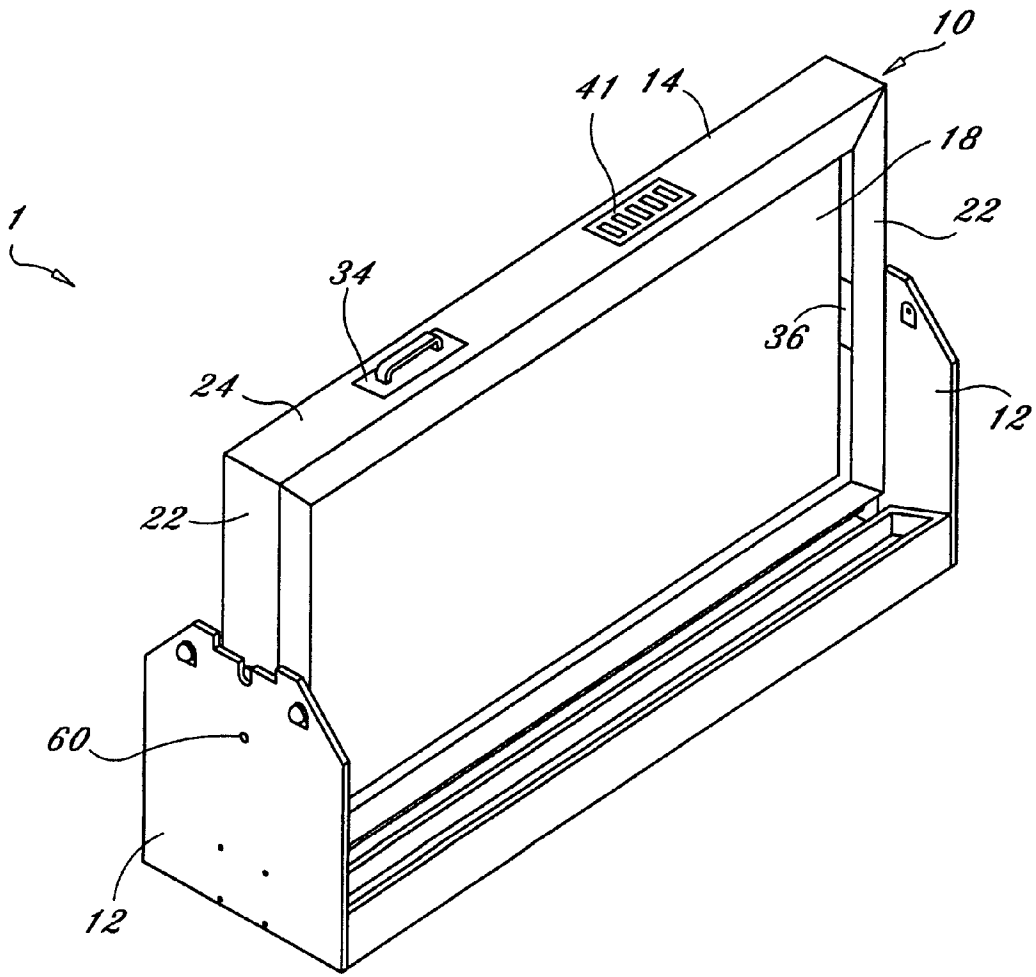
FIG. 3 is a perspective view of a rotary game table with a combination game table in a vertical orientation in accordance with the present invention.
Figure 4:
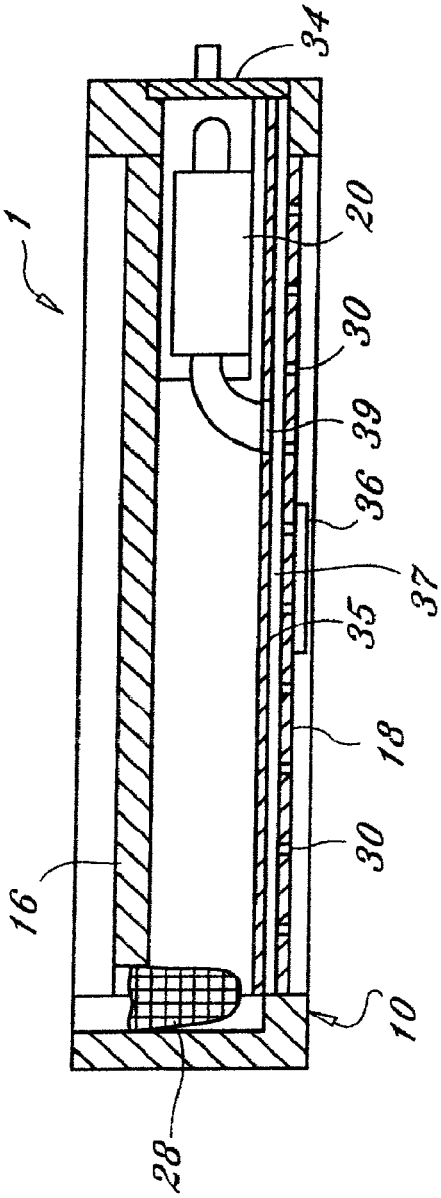
FIG. 4 is a cross sectional view of a combination game table of a rotary game table in accordance with the present invention.

With reference now to the drawings, and particularly to FIG. 1, there is shown a perspective view of a rotary game table 1. With reference to FIGS. 2-4, the rotary game table 1 includes a combination game table 10, two side support members 12 and at least one cross member. The combination game table 10 includes a game frame 14, a pool table surface 16, an air powered hockey surface 18 and an air blower 20. The pool table surface 16 is formed on one side of the combination game table 10 and an air powered hockey table surface 16 formed on the opposite side. The size of the pool table surface 16 has the same dimensions as a regulation pool table. The game frame 14 preferably includes two end frame members 22 and two lengthwise frame members 24. The two end frame members 22 are attached to the two lengthwise frame members 24 with any acceptable fastening process, such as glue or fasteners.

A perimeter of the pool table surface 16 is preferably attached to an inside perimeter of the game frame 14 with threaded fasteners, but other attachment methods may also be used. The air powered hockey surface 18 is preferably attached to an inside perimeter of the game frame 14 with glue, but other attachment methods may also be used. Pool ball pockets 26 are formed in the end frame members 22, the lengthwise frame members 24 and the pool table surface 16. The pool ball pockets 26 are formed substantially through a height of the end and lengthwise frame members. Preferably, a net 28 is attached to a wall of each pool ball pocket 26 to capture a billiard ball that falls therein.

The air powered hockey table surface 18 includes a plurality of air holes 30 formed therethrough. A diffuser plate 35 is disposed below the air powered hockey table surface 18 such that an air gap 37 is maintained therebetween. The air blower 20 is preferably retained in a sliding drawer 34 between the pool and air powered hockey table surfaces. An air hole 39 is formed through the diffuser plate 35 to receive an output of the air blower 20. The air blower 20 draws air from inside the combination game table 10 and preferably through at least one air vent 41 formed through the frame 14. The air output from the air blower 20 flows through the air hole 39 into the air gap 37 created by the diffuser plate 35 and through the plurality of air holes 30 in the air powered hockey table surface 18. The drawer 34 is required to allow the air blower 20 to be removed from the combination game table 10 for replacement. A puck slot 36 is formed through each end frame member 22 to enable scoring in a game of air powered hockey.

Figure 4A:
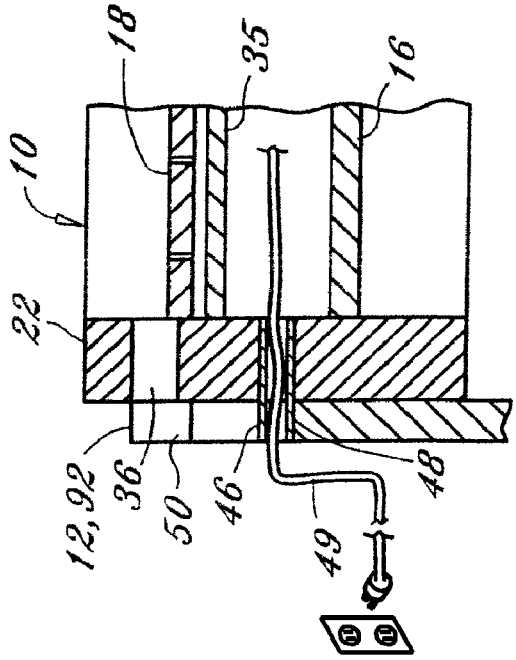
FIG. 4*a* is a cross sectional view of an electrical cord of an air blower routed through a pivot pin of a rotary game table in accordance with the present invention.

At least one cross member 38 is preferably terminated by an end cap 40 on each end thereof. The end cap 40 is attached to an end of the at least one cross member 38 and to one of the two side support members 12 with any suitable fastening method. Preferably, an end of at least one accessory retainer 42 is attached to one of the side support members 12 with any suitable fastening method. Each accessory retainer 42 includes an accessory trough 44. The accessory trough is configured to retain a plurality of game accessories such as a plurality of billiard balls, cue sticks, a rack, a puck, and two hockey paddles. With reference to FIG. 4*a*, an electrical cord 49 is routed through a tubular pivot pin 46. The pivot pin 46 extends from each end of the combination game table 10. A pivot slot 48 is preferably formed in a top of each side support member 12, 92 to pivotally receive the pivot pin 46. The other pivot pin 46 does not have to be tubular, but may be solid. A puck clearance slot 50 is also formed in a top of each side support member 12, 92. The electrical cord 49 of the air blower 20 is preferably run through one of the pivot pins 46.

Figure 6:
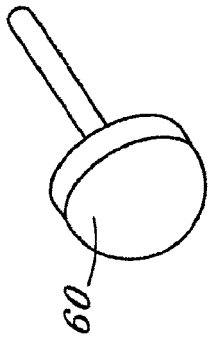
FIG. 6 is an enlarged perspective view of a locking pin of a rotary game table in accordance with the present invention.
Figure 5:
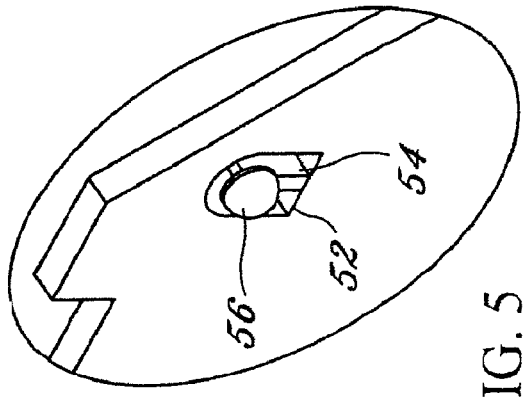
FIG. 5 is an enlarged perspective view of a locking pin device of a rotary game table in accordance with the present invention.
Figure 8:
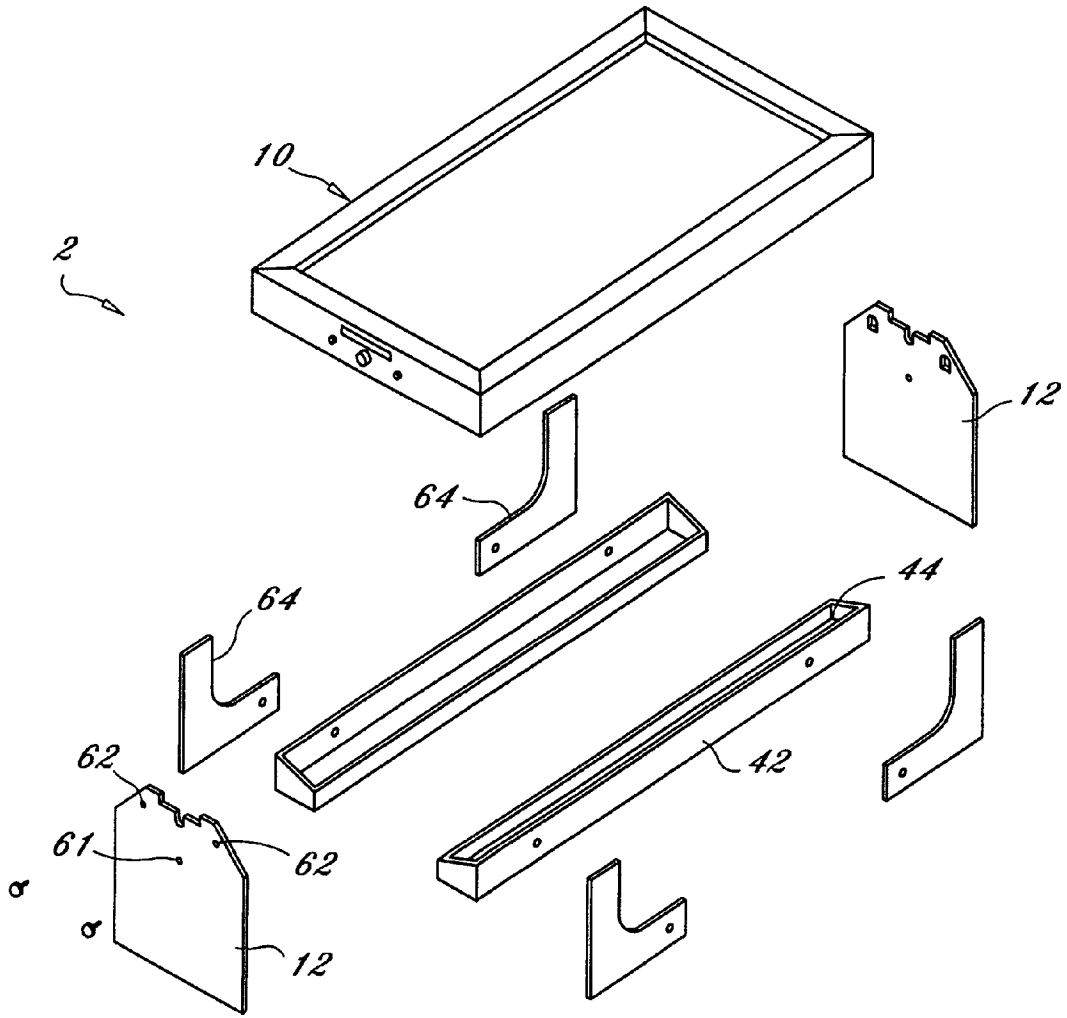
FIG. 8 is a partially exploded perspective view of a second embodiment of a rotary game table in accordance with the present invention.

With reference to FIG. 5, at least one locking pin device 52 is disposed in at least one of the two side support members 12. The locking pin device 52 includes a locking body 54 and a spring pin 56. The spring pin 56 is retained in the locking body 54. The spring pin 56 is spring loaded inside the locking body 54; such that the spring pin 56 is biased in an extended position. At least one pin cavity 58 is formed in at least one end of the combination game table 10 to receive a respective spring pin 56. The respective spring pin 56 is withdrawn from the at least one pin cavity 58 to allow the game table to be rotated for storage or to change the game surface. Spring loaded locking pins are well known in the art and need not be explained in detail. With reference to FIG. 6, the locking pin device 52 may be replaced with a separate locking pin 60. With reference to FIG. 8, a pin hole 62 is formed through the side support member 12 instead of attaching the locking pin device 52. The locking pin 60 is withdrawn from each side support member 12 to allow rotation of the combination game table 10. To retain the combination game table 10 in a vertical orientation, a pin hole 61 is formed through at least one side support member 12. The pin hole 61 is disposed in the side support member 12 to be concentric with the at least one pin cavity 58. The locking pin 60 is inserted through the pin hole 61 and into the at least one pin cavity 58.

Figure 7:
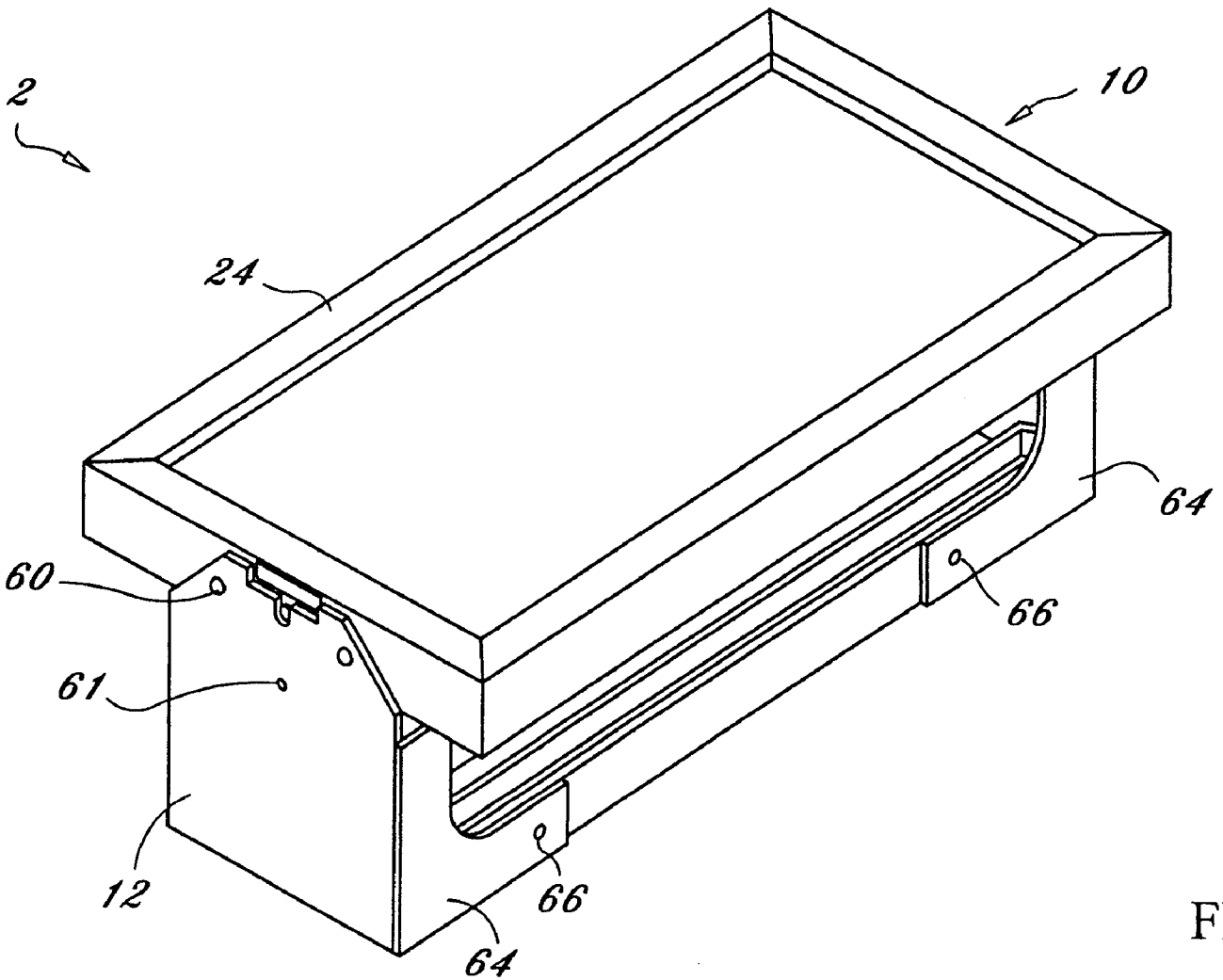
FIG. 7 is a perspective view of a second embodiment of a rotary game table in accordance with the present invention.
Figure 9:
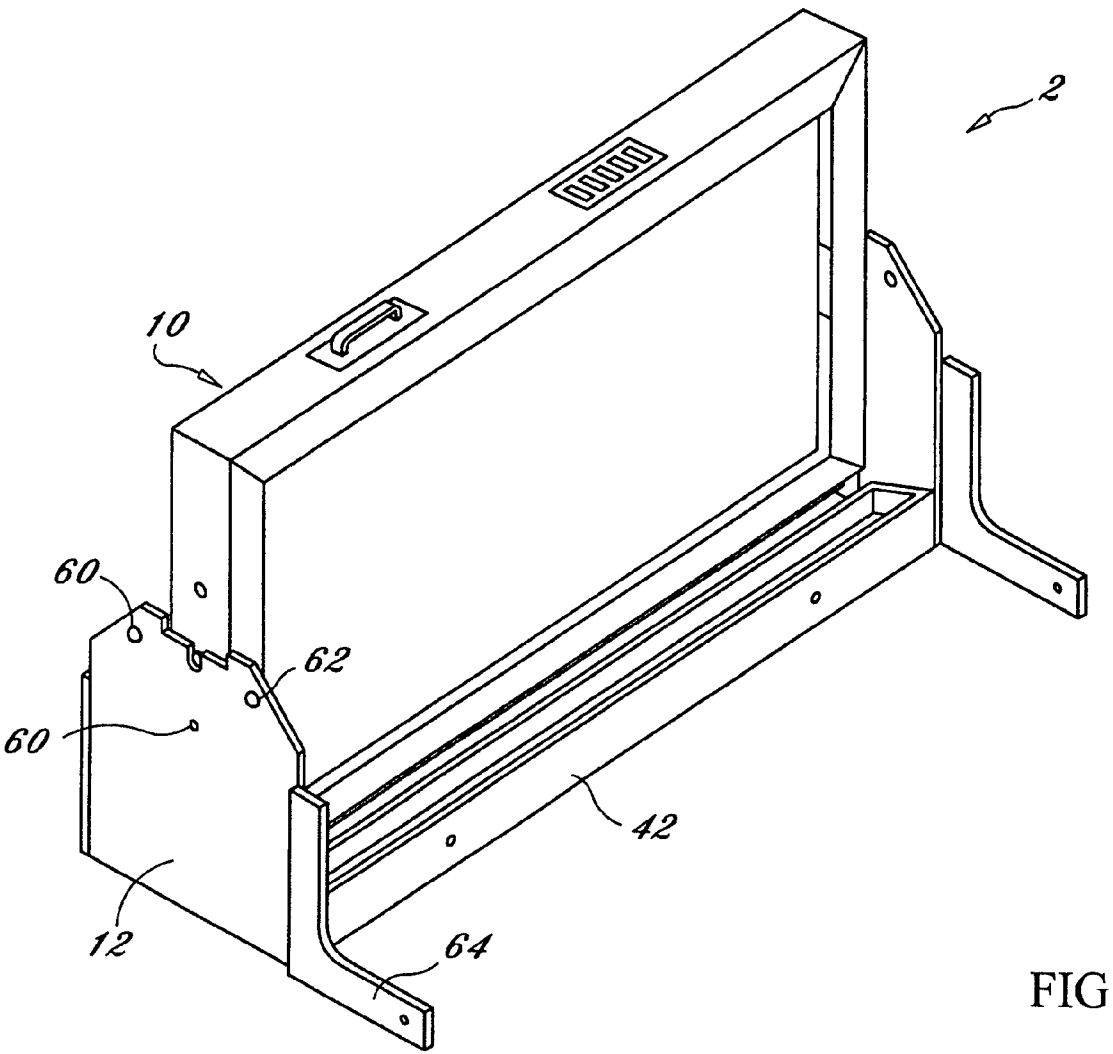
FIG. 9 is a perspective view of a second embodiment of a rotary game table with a combination game table in a vertical orientation in accordance with the present invention.

With reference to FIGS. 7-9, a second embodiment of a rotary game table 2 includes a combination game table 10, two side support members 12, at least two pivotal support arms 64 and at least one cross member. The combination game table 10 is the same as that of the rotary game table 1. Preferably, at least one accessory retainer 42 acts as the at least one cross member. One of the two side support members 12 is attached to each end of the at least one accessory retainer 42 with any suitable fastening process. The combination game table 10 is pivotally retained by a single side support member 12 on each end thereof. Each pivotal support arm 64 is pivotally attached to one end of the side support member 12 with at least one hinge or any other suitable pivotal retention device.

To rotate the combination game table 10, the pivotal support arms 64 are swung outward such that they are parallel with the side support members 12. The pivotal support arms 64 are swung inward to retain the combination game table 10 in a horizontal orientation. Each pivotal support arm 64 is attachable to a single accessory retainer 42 with any suitable quick release fastener 66. Quick release fasteners are well known in the art and need not be explained in detail. Use of the at least two pivotal support arms 64 eliminates the need for the use of locking pin devices 52 or locking pins 60. However, the locking pin devices 52 or locking pins 60 may also be used in conjunction with the four pivotal support arms 64.

Figure 10:
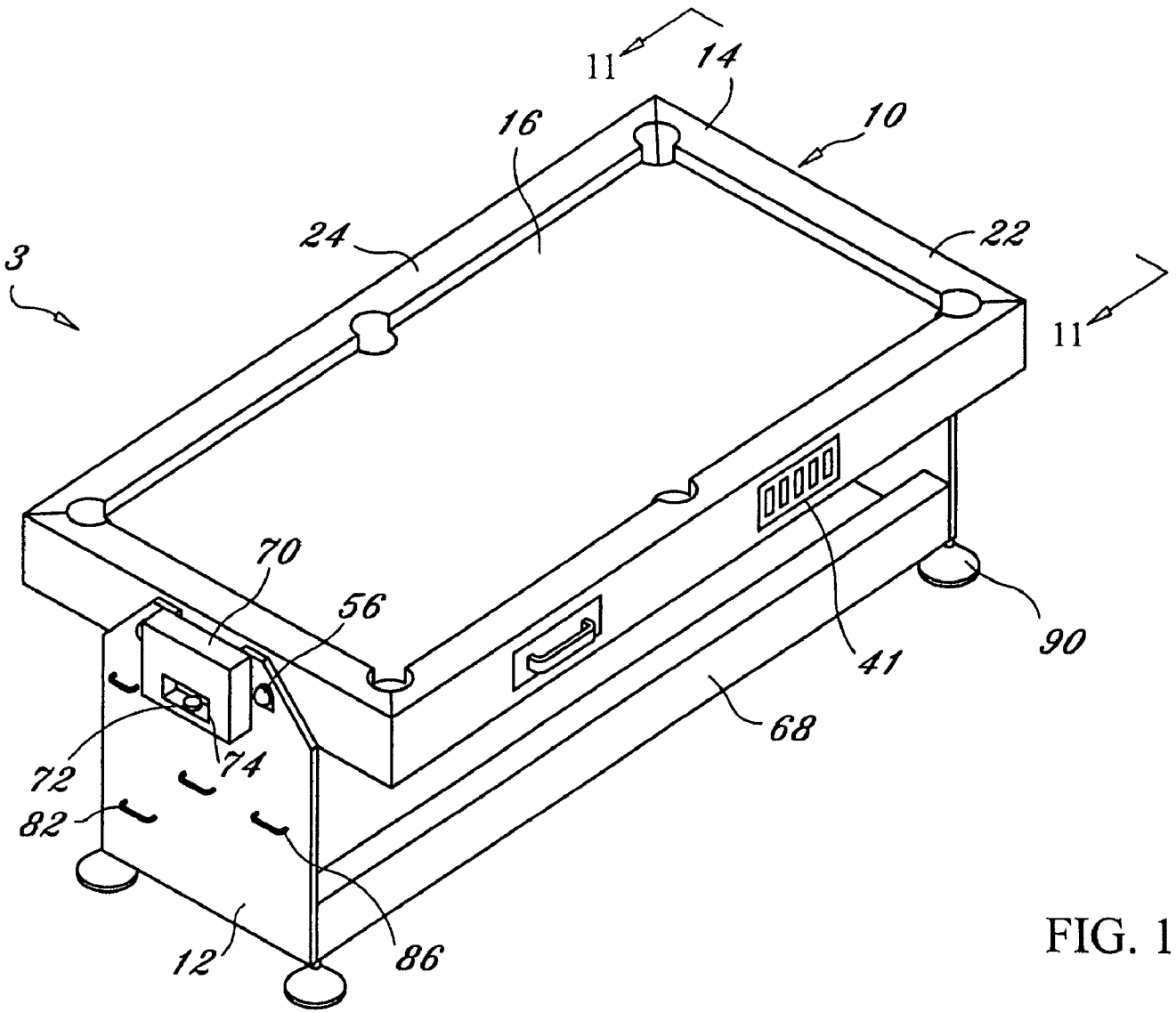
FIG. 10 is a perspective view of a third embodiment of a rotary game table in accordance with the present invention.
Figure 11:
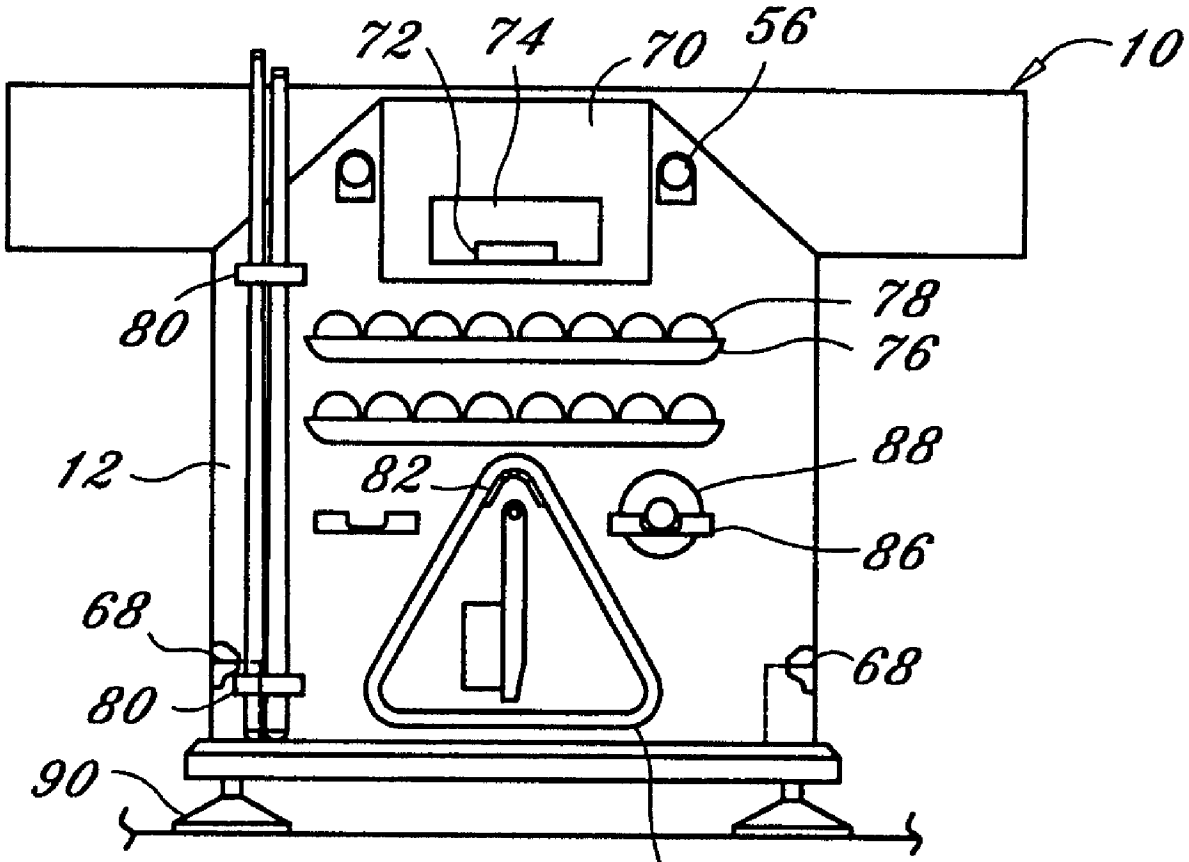
FIG. 11 is a front view of a side support member not shown in FIG. 10 of a third embodiment of a rotary game table in accordance with the present invention.

With reference to FIGS. 10-11, a third embodiment of a rotary game table 3 includes a combination game table 10, two side support members 12 and at least one cross member 68. The combination game table 10 is the same as that of the rotary game table 1. One of the two side support members 12 is attached to each end of the at least one cross member 68 with any suitable fastening process. The combination game table 10 is pivotally retained by a single side support member 12 on each end thereof.

A hockey puck housing 70 is preferably attached to the support member 12. When a player is successful in scoring, a hockey puck 72 will fall into a puck tray 74 in the hockey puck housing 70. At least one ball tray 76 is preferably mounted to one of the two side support members 12 to retain a plurality of billiard balls 78. At least two pool cue racks 80 are preferably attached to at least one side support member 12. A rack holder 82 is preferably attached to one of the two side support members 12 to retain a rack 84. At least one paddle holder 86 preferably retains a single hockey paddle 88. To rotate the combination game table 10, at least one spring pin 56 of the at least one locking pin device 52 is withdrawn from the at least one pin cavity 58 to allow the game table to be rotated for storage or to change the game surface.

At least one locking pin 60 may be substituted for the at least one locking pin device 52. Further, the at least two pivotal support arms 64 of the second embodiment may also be substituted for the at least one locking pin device 52. Each pivotal support arm 64 would be pivotally attached to a single side support member 12 with at least one hinge or any other suitable pivotal retention device. Each pivotal support arm 64 would be attached to a single cross member 68 with any suitable quick release fastener 66. Quick release fasteners are well known in the art and need not be explained in detail. Four height adjustable feet 90 are preferably used to level the rotary game table 3. The four height adjustable feet 90 may also used on the rotary game table 1, 2.

Figure 12:
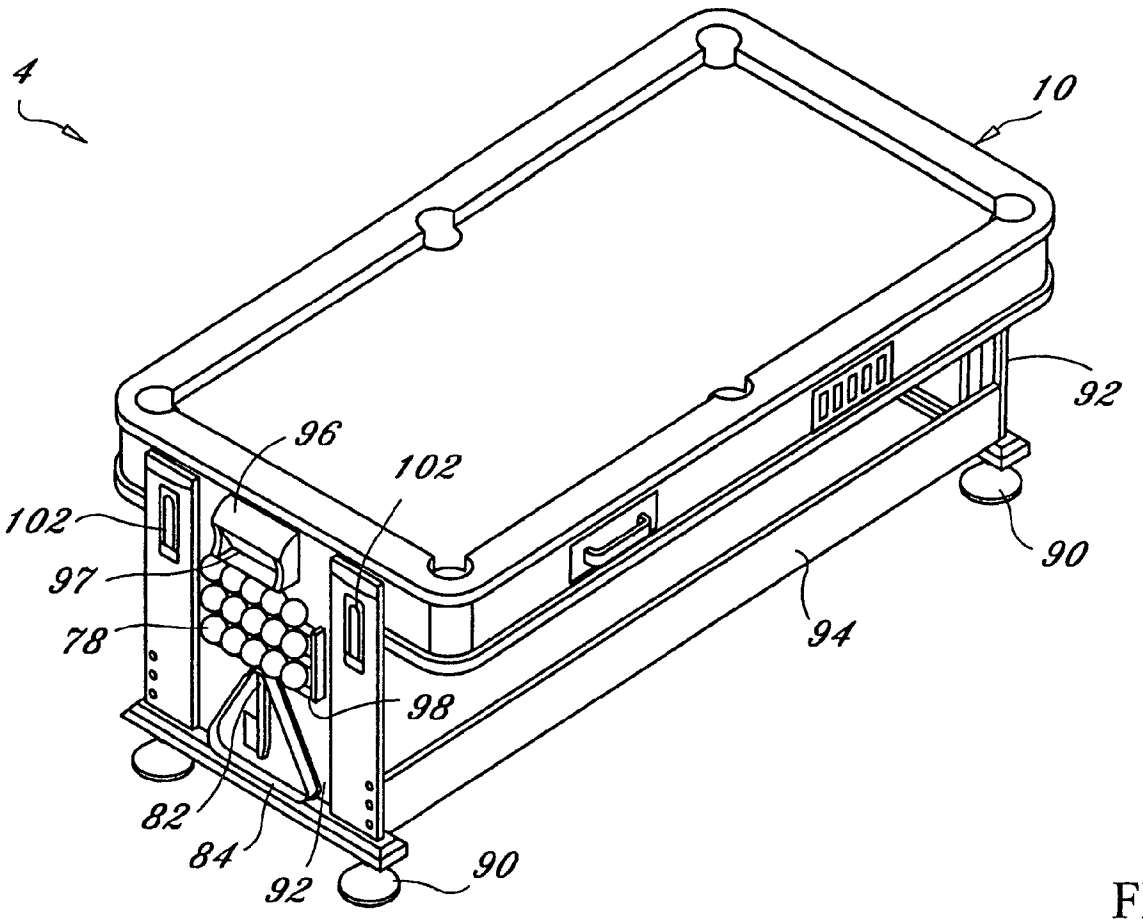
FIG. 12 is a perspective view of a fourth embodiment of a rotary game table in accordance with the present invention.
Figure 13:
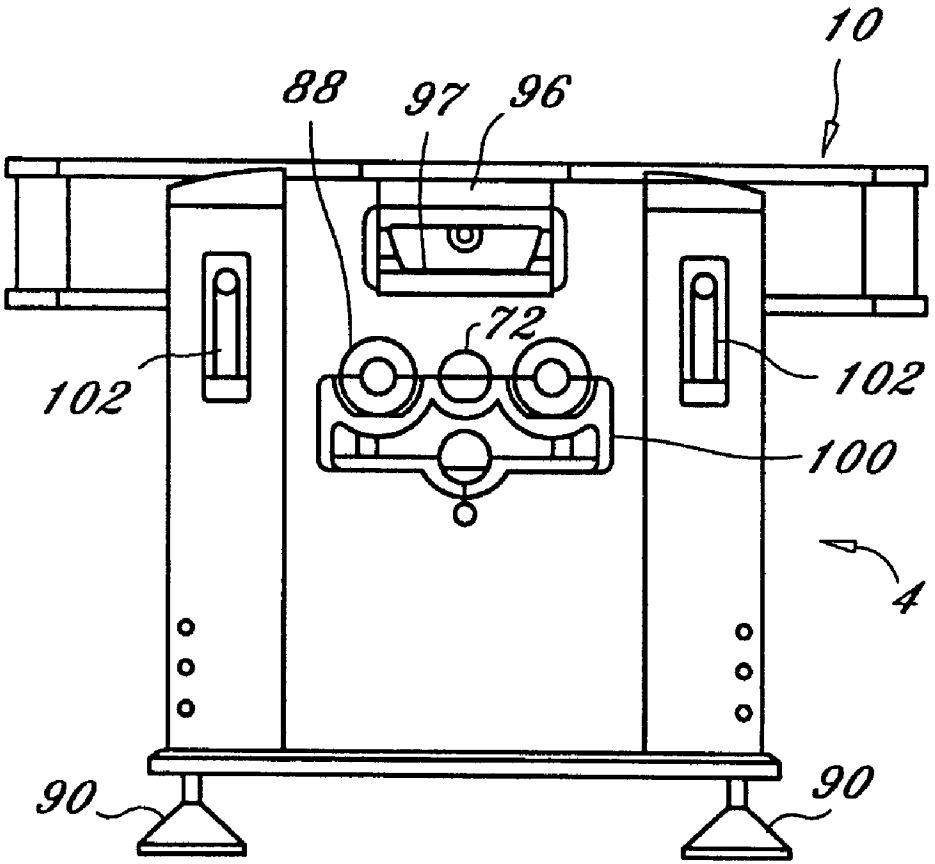
FIG. 13 is a front view of a side support member not shown in FIG. 12 of a fourth embodiment of a rotary game table in accordance with the present invention.

With reference to FIGS. 12-13, a fourth embodiment of a rotary game table 4 includes a combination game table 10, two side support members 92 and at least one cross member 94. The combination game table 10 is the same as that of the rotary game table 1. One of the two side support members 92 is attached to each end of the at least one cross member 94 with any suitable fastening process. The combination game table 10 is pivotally retained by a single side support member 92 on each end thereof.

A hockey puck housing 96 is preferably attached to each side support member 92. When a player is successful in scoring, the hockey puck 72 will fall into a puck tray 97 in the hockey puck housing 96, disposed on each side support member 92. At least one ball tray 98 is preferably mounted to one of the two side support members 92 to retain a plurality of billiard balls 78. A rack holder 82 is preferably attached to one of the two side support members 12 to retain a rack 84. A paddle/puck holder 100 preferably retains the hockey puck 72 and two hockey paddles 88. Four height adjustable feet 90 are preferably used to level the rotary game table 4.

Figure 15:
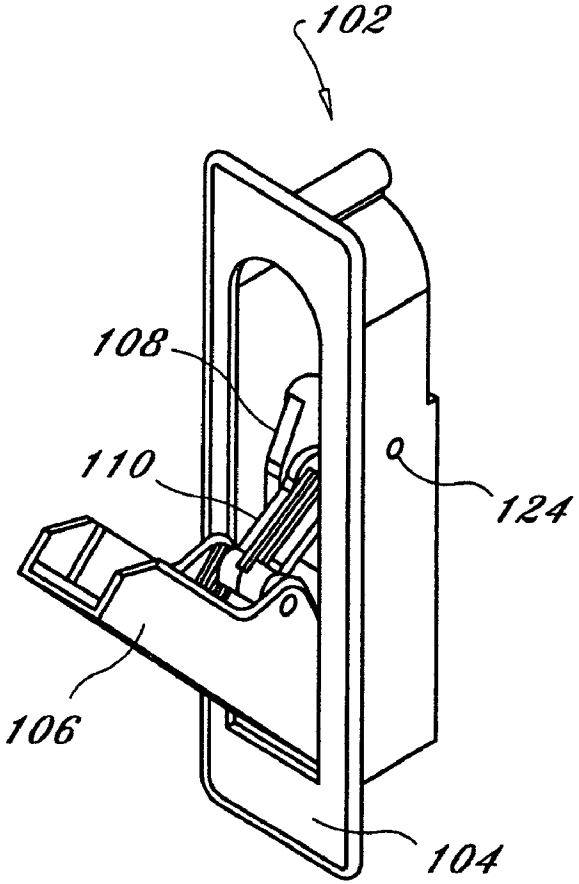
FIG. 15 is a perspective view of a support latch in a retracted orientation of a fourth embodiment of a rotary game table in accordance with the present invention.
Figure 14:
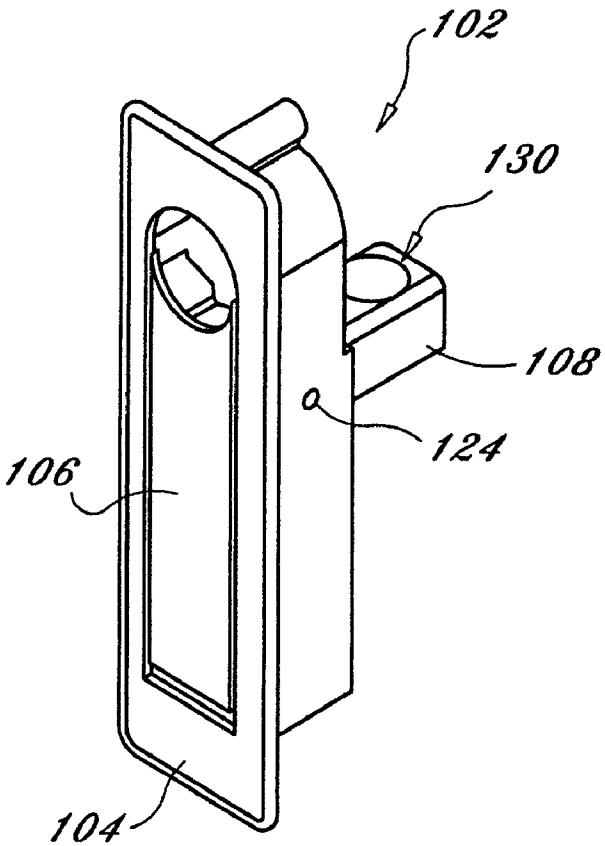
FIG. 14 is a perspective view of a support latch in a locked orientation of a fourth embodiment of a rotary game table in accordance with the present invention.
Figure 16:
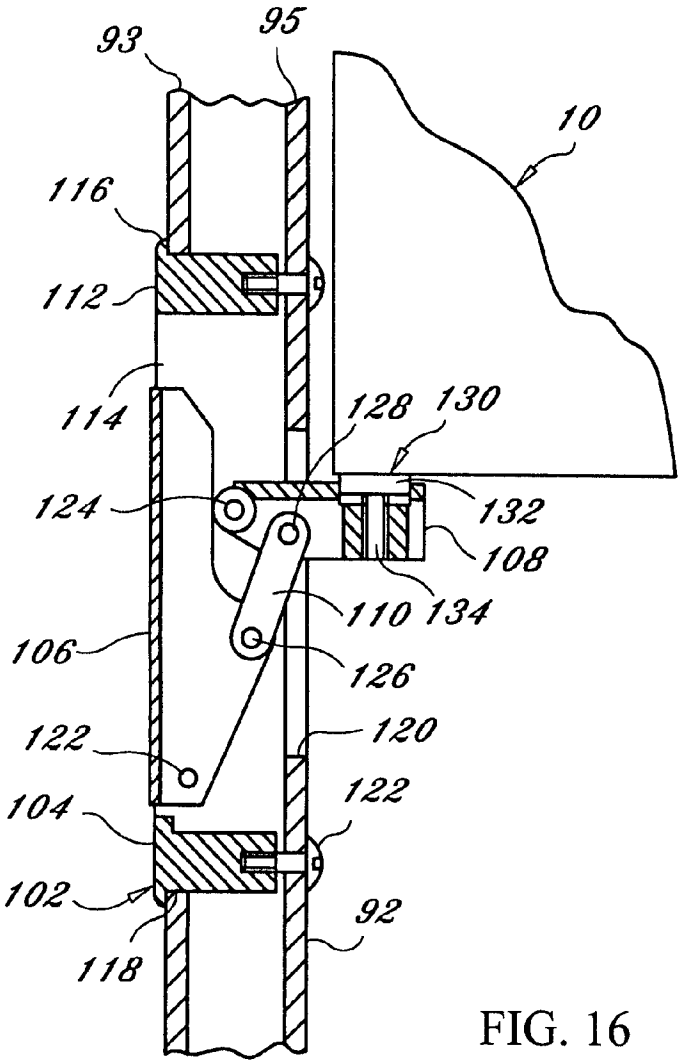
FIG. 16 is a cross sectional view of a support latch in a locked orientation of a fourth embodiment of a rotary game table in accordance with the present invention.

With reference to FIGS. 14-16, a pair of support latches 102 are retained in at least one of the two side support members 92 with any suitable fastening method. The support latch 102 includes a latch frame 104, a latch lever 106, a support link 108 and a latch link 110. The latch frame 104 includes a lever housing 112 with a substantially rectangular opening 114 formed therethrough. A flange 116 is preferably formed on a front periphery of the lever housing 112. The side support member 92 is shown as having a first wall 93 and a second wall 95. However, the side support member 92 may also be solid, or partially hollow and partially solid.

A first latch opening 118 is formed through the first wall 93 to receive the outer periphery of the lever housing 112. A second latch opening 120 is formed through the second wall 95 to provide clearance for the movement of the support link 108. The latch lever 102 is preferably retained in the side support member 92 with at least two fasteners 122. The substantially rectangular opening 114 is sized to receive the latch lever 106. The latch lever 106 is pivotally retained by the latch frame 104 with a lever pin 122 or the like. The support link 108 is pivotally retained by the latch frame 104 with a support pin 124 or the like, adjacent the latch lever 106. One end of the latch link 110 is pivotally retained by the lever 106 with a first link pin 126 and the other end of the latch link 110 is pivotally retained by the support link 108 with a second link pin 128 or the like. FIG. 14 shows the support latch 102 in a locked position and FIG. 15 shows the support latch 102 in a retracted position.

A slack adjuster 130 extends from a top of each support link 108. The slack adjuster ensures that the combination game table 10 does not rock or wobble, when both support latches 102 are in a locked position. The support link 108 is in a support position, when the support latch is in a locked position and the support link 108 is in a retracted position, when the support latch is in a retracted position. The slack adjuster 130 preferably includes a contact base 132 and a threaded rod 134 extending from a bottom of the contact base 132. The contact base 132 is preferably fabricated from a resilient material to prevent damage to the combination game table 10. A threaded hole is formed in the support link 108 to threadably receive the threaded rod 134. The slack adjuster 130 is rotated upward to prevent the combination game table 10 from pivoting relative to the two side support members 92. The combination game table 10 is rotated by retracting the two support latches 102 in at least one side support member 92. After the combination game table 10 is rotated to the opposite game surface, the support latches 102 are locked.

To retain the combination game table 10 in a vertical orientation, a pin hole would be formed through at least one side support member 92, similar to the pin hole 61 shown in FIG. 7. The at least one pin cavity 58 would be formed in the combination game table 10 as shown in FIG. 2, concentric with the pin hole 61. The locking pin 60 is inserted through the pin hole 61 and into the at least one pin cavity 58 to retain the game table 10 in a vertical orientation.

Figure 17:
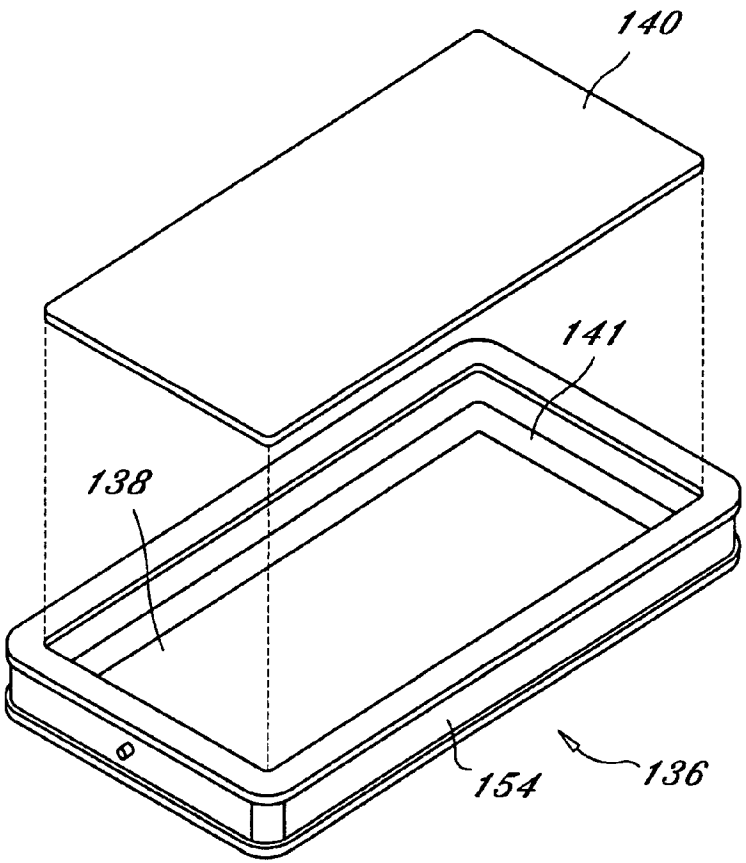
FIG. 17 is a perspective view of a combination game table with a gaming pocket on one side and a pool table surface on the other side thereof of a rotary game table in accordance with the present invention.
Figure 18:
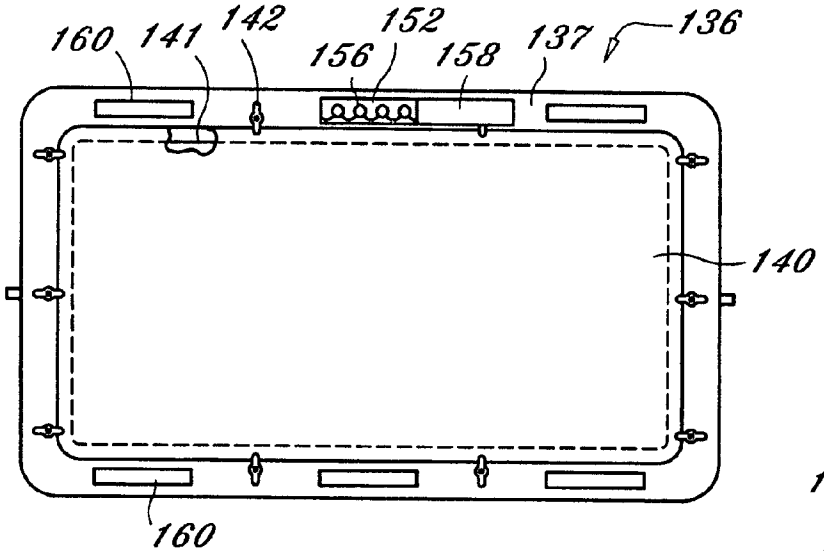
FIG. 18 is a top view of a combination game table with a gaming pocket on one side and a pool table surface on the other side thereof of rotary game table in accordance with the present invention.
Figure 19:
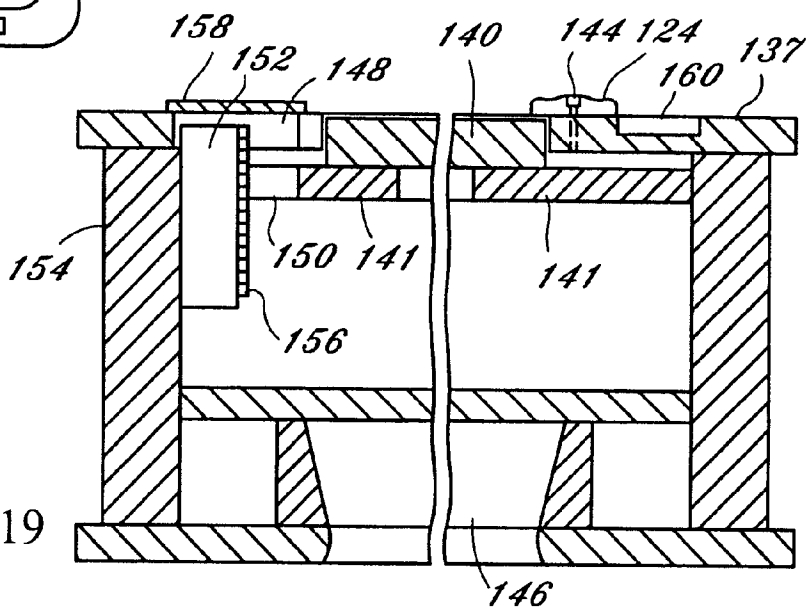
FIG. 19 is an enlarged partial cross sectional view of a combination game table with a gaming pocket on one side and a pool table surface on the other side thereof of rotary game table in accordance with the present invention.

With reference to FIGS. 17-19, one side of a combination game table 136 includes a gaming pocket 138 that is sized to receive a gaming insert 140. The combination game table 136 may be substituted for the combination game table 10 in any of the preferred embodiments 1-4. The gaming pocket 138 is formed through a gaming plate 137. The gaming insert 140 may be a roulette table, a black jack table, a craps table or any other appropriate gambling table. A support rim 141 preferably supports the gaming insert 140 and acts as a bottom of the gaming pocket 138. A plurality of lock clips 142 are used to retain the gaming insert 140 in the gaming pocket 138. Each lock clip 142 is preferably retained with a screw 144. One end of each lock clip 142 is twisted over the gaming insert 140 to lock thereof in the gaming pocket 138. The lock clip 142 is twisted 90 degrees to allow removal of the gaming insert 140 from the gaming pocket 138. A pool table surface 146 is preferably formed on the opposite surface of the rotary game table 136, but other game surfaces may also be formed thereupon, such as an air hockey surface.

A plate opening 148 is formed through the gaming plate 137 and a rim opening 150 is formed through the support rim 141 to provide clearance for a dealer chip holder 152. The plate and rim openings provide enough clearance for a dealer to insert their finger therethrough to retrieve chips from the dealer chip holder 152. The dealer chip holder 152 is attached to a side frame member 154 with any suitable attachment method. The dealer chip holder 152 retains a plurality of chips 156. Chip holders are well known in the art and need not be explained in detail. A chip cover 158 is preferably removably attached to a top of the plate opening 148 with any suitable method. A plurality of chip pockets 160 are formed in the gaming plate 137 to receive an individual player's chips.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A multi-game game table comprising:

a rotatable table having a first game formed on one side and another game formed on another side;

a support; and a pin connected to the rotatable table and engaged with the support and having a power cord passing therethrough.

2. The multi-game game table of claim 1 further comprising a space formed between the first game and the another game, the space constructed to receive an electrical device therein, the electrical device electrically connected to a first end of the power cord.

3. The multi-game game table of claim 2 wherein the electrical device is an air blower.

4. The multi-game game table of claim 2 further comprising a plug attached to a second end of the power cord and constructed to engage an outlet.

5. The multi-game game table of claim 1 wherein at least one of the first game and the second game is an air-powered hockey game.

6. The multi-game game table of claim 1 further comprising another support attached to the rotatable table by another pin and located generally opposite the support such that the rotatable table is rotatable about the pin and another pin.

7. A combination game table comprising:

a first game surface;

a second game surface;

a frame connecting the first game surface and the second game surface and forming a cavity therebetween;

a pin extending from the frame to a support and constructed to allow rotation of the frame thereabout; and an electrical cord passing through the pin and constructed to power an electrical device located in the cavity.

8. The combination game table of claim 7 wherein the electrical device is an air blower constructed to draw air from the cavity and discharge air to one of the first game surface and the second game surface.

9. The combination game table of claim 7 further comprising an opening formed through the frame and constructed to fluidly connect the cavity to atmosphere external to the frame.

10. The combination game table of claim 7 further comprising a drawer slideably attached to the frame.

11. The combination game table of claim 10 wherein the electrical device is attached to the drawer.

12. The combination game table of claim 7 further comprising a first support connected to the frame by the pin and a second support connected to the frame by another pin wherein the first support and second support are located at generally opposite ends of the frame.

13. The combination game table of claim 12 further comprising a catch attached to at least one of the first support and the second support, the catch constructed to removeably engage the frame and prevent rotation of the frame when engaged therewith.

14. A rotatable game table comprising:

a table having one game formed on a first side and another game formed on a second side;

a frame extending about the table between the first side and the second side; and a pivot tube extending from the frame to a support and constructed to allow rotation of the table, the pivot tube having a power cord directed therethrough.

15. The rotatable game table of claim 14 further comprising an air blower electrically connected to an end of the power cord.

16. The rotatable game table of claim 15 further comprising a drawer slideably connected to the table and having the air blower positioned therein.

17. The rotatable game table of claim 14 further comprising a pair of supports attached to generally opposite ends of the table, the pivot tube extending through one of the pair of supports and a pin connecting the frame to another of the pair supports.

18. The rotatable game table of claim 14 further comprising a plug constructed to engage an outlet attached to an end of the power cord.

19. The rotatable game table of claim 14 wherein at least one of the one game and the another game is an air hockey game.

* * * * *